United States Patent [19]

Schmidt et al.

[11] Patent Number: 4,964,453

[45] Date of Patent: Oct. 23, 1990

[54] DIRECTIONAL SOLIDIFICATION OF SUPERALLOYS

[75] Inventors: Deborah D. Schmidt, Huntsville, Ala.; Wendy S. Alter, Bow, Wash.; William D. Hamilton, Huntsville, Ala.

[73] Assignee: The United States as represented by the Administrator of the National Aeronautics and Space Administration, Washington, D.C.

[21] Appl. No.: 404,289

[22] Filed: Sep. 7, 1989

[51] Int. Cl.[5] ..... B22D 27/04

[52] U.S. Cl. ..... 164/122.1; 164/338.1

[58] Field of Search ..... 164/122.1, 122.2, 338.1

[56] References Cited

U.S. PATENT DOCUMENTS

| | | | |
|---|---|---|---|
| 2,229,866 | 1/1940 | Munro | 148/3 |
| 2,875,483 | 3/1959 | Hughes . | |
| 3,124,452 | 3/1964 | Kraft | 75/135 |
| 3,495,649 | 2/1970 | Waters . | |
| 3,515,546 | 6/1970 | Greenewald | 75/138 |
| 3,669,180 | 6/1972 | Moore | 164/122 |
| 3,770,047 | 11/1973 | Kirkpartick | 164/338 |
| 3,842,895 | 10/1974 | Mehrabian . | |
| 4,033,401 | 7/1977 | Wlodawer | 164/121 |
| 4,057,097 | 11/1977 | Lux . | |
| 4,175,609 | 11/1979 | El Gammal et al. | 164/122.2 |
| 4,318,753 | 3/1982 | Anderson | 148/3 |
| 4,411,713 | 10/1983 | Betts | 148/35 |
| 4,434,014 | 2/1984 | Smith | 148/3 |
| 4,540,038 | 9/1985 | Burke | 164/499 |
| 4,717,432 | 1/1988 | Ault | 148/162 |

*Primary Examiner*—Kuang Y. Lin

*Attorney, Agent, or Firm*—William J. Sheehan; Jerry L. Seemann; John R. Manning

[57] ABSTRACT

This invention relates to the directional solidification of superalloys, in particular nickel-based superalloys, by imposition of a predetermined temperature profile in the solidification front and, depending on the desired results, a predetermined rate of advance of said solidification front, whereas castings of markedly superior fatigue resistance are produced.

7 Claims, 2 Drawing Sheets

DIRECTIONAL SOLIDIFICATION OF SUPERALLOYS

The invention described herein was made by employees of the United States Government; it may be used by or for the Government for Government purposes without the payment of any royalties thereon or therefor.

FIELD OF THE INVENTION

This invention relates to the directional solidification of superalloys, including in particular nickel-based superalloys, by imposition of a predetermined temperature profile across the solification front.

BACKGROUND OF THE INVENTION

Superalloys are metal alloys usually based on nickel or cobalt having high tensile strength and resistance to fatigue at high temperatures. These alloys, therefore, have potential use in the manufacture of turbopump blades for the Space Shuttle main engines, as well as blades for aircraft, marine and aerospace gas turbines.

Directional solidification of alloy castings has been achieved heretofore by the progressive advance of a solidification front between the solid and the liquid phase which permits the growth of a reinforcement phase in the form of dendrites.

Many improvements on this process have been attempted in the prior art. U.S. Pat. No. 4,057,097 discloses a method of unidirectional solidification comprising casting a melt of the alloy into a mold, followed by progressive cooling with a temperature gradient along the length of the casting until a metastable equilibrium is reached, the entire body of the melt being in a supercooled state as a homogeneous liquid. This super-cooled liquid is then instantly solidified by disturbance of the metastable equilibrium.

U.S. Pat. No. 4,540,038 discloses a two-step solidification process for turbine blades. The airfoil section of the turbine blades is solidified at a slow rate so as to effect directional solidification, while the root section of the turbine blade is solidified with magnetic stirring at a faster rate than applied heretofore so as to eliminate any inhomogeneous portion at the interface between the airfoil and root sections.

U.S. Pat. No. 3,669,180 discloses the production of fine-grained ingots of superalloy by solidification of a well stirred two-phase liquid/solid mixture in two separately controlled thermal zones. The upper zone is controlled to maintain the mixture liquid while the lower zone is being solidified, whereby the liquid fills any shrinkage due to the solidification below it.

Thus far, there has been no satisfactory process available for solidifying of superalloys and creating a fine microstructure which results in improved fatigue resistance.

BRIEF SUMMARY OF THE INVENTION

The objective of this invention is to provide an improved process for the directional solidification of superalloys by imposition of a predetermined temperature profile between the liquidus and solidus temperatures during the solidification at a controlled rate of progress of the solidification front, whereby the formation of brittle phases, which are deleterious to fatigue resistance, is controlled, minimized and/or eliminated. Such brittle phases include but are not limited to gamma/-gamma' eutectic phase and carbides. Control can also be obtained for a phenomenon referred to as microsegregation. Reduced microsegregation, control of a carbide morphology, dendrite arm spacings and gamma/-gamma' eutectic formation improve the mechanical properties of directionally solidified alloy castings.

DETAILED DESCRIPTION OF THE PREFERRED EMBODIMENT

Figure 1:
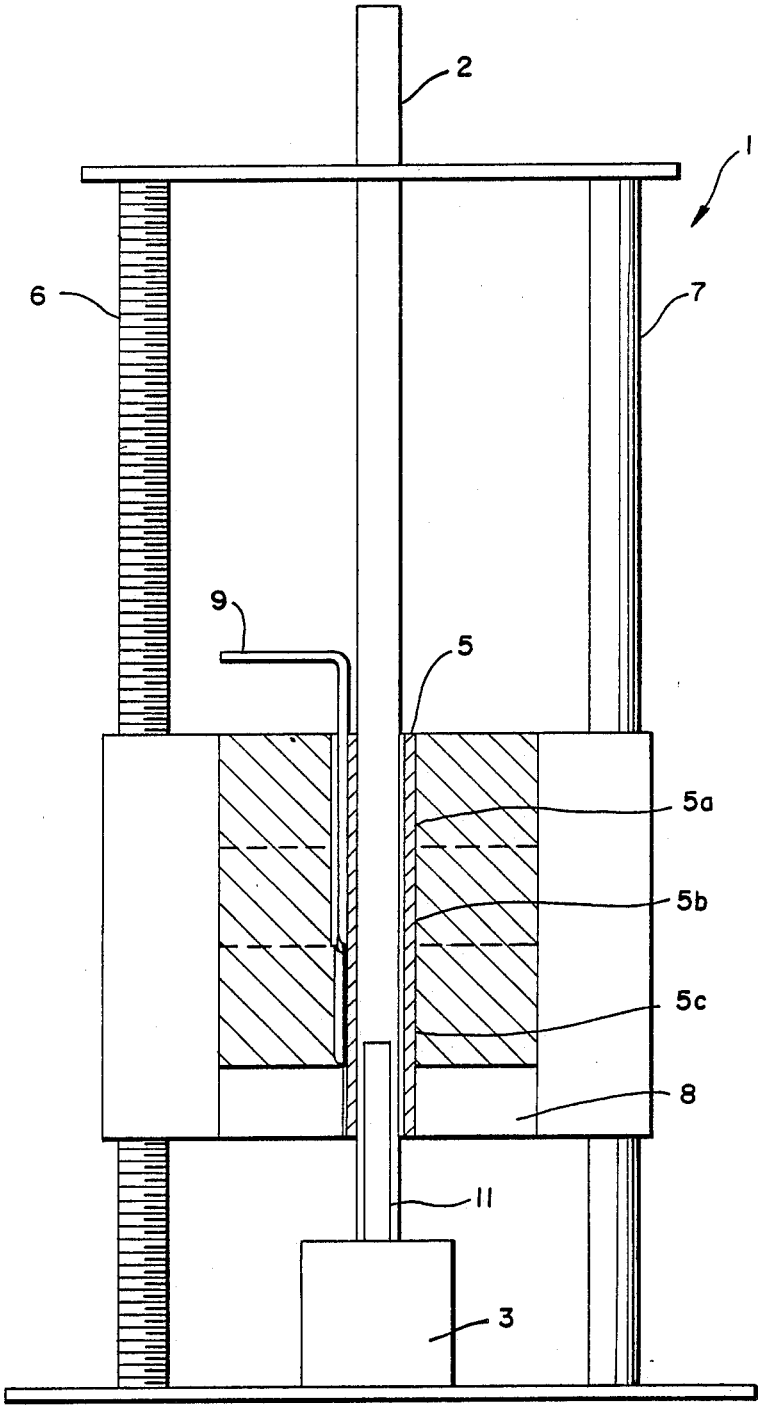
FIG. 1 is a cross-sectional view of a multiple-zone directional solidification furnace.

A brief description of the furnace used in conjunction with the present invention is necessary in order to facilitate understanding of the invention. As depicted in FIG. 1, the furnace 1 consists of a centrally disposed elongated alumina crucible 2, supported by a base 3. A cage-type furnace body 4 having a central opening to slidably house the crucible 2, contains multiple heating cores 5. Three such heating cores *5a*, *5b*, and *5c*, are illustrated. A copper quench block is disposed below heating core *5c*.

However, a different number of such heating cores may be employed, the number of cores used depending on the temperature profile to be imposed. In this specific case, the three heating cores are for slow cooling in *5a*, substantially no cooling at isothermal conditions in *5b*, and faster cooling in *5c*. The nature of this temperature profile will be discussed hereinafter.

The heating cores are isolated from each other and from the furnace wall including the quench block, 8, below the last core *5c* by thermal insulation. The temperature profile across the solidification front is indicated by thermocouples, 9, and regulated by adjustment of the heat imput to the heating cores via the elecric current flowing through the heating wires of said heating cores. By solidification front as used herein is meant the zone between the liquidus temperature, where solidification begins, and the solidus temperature, where solidification is complete.

The cage-like furnace 1 travels vertically on a drive rod 6 and guide rod 7. The drive rod has a male thread which engages a part of the furnace having a female thread such that the rate of at which the furnace advances upward is controlled by the speed at which the drive rod 6 is rotated by external means, which are not shown.

In operation, pellets of a superalloy are placed on a pedestal 11, connected to the base 3. The heating core *5a* is positioned near the pellets and heat is added to melt the pellets. Alternatively, the superalloy may be melted externally in separate equipment before being introduced into zone *5a*. Inert gas, such as argon or nitrogen, is passed over the melting superalloy to prevent its oxidation by air.

The melt is then cooled with a predetermined temperature profile and can be complimented with a predetermined rate. As the heating cores travel upward, crystal nuclei begin to form in the liquid melt when it reaches the liquidus temperature. In core *5b*, the liquid melt is maintained at or near the liquidus temperature for a predetermined time. In core *5c*, the mixture is cooled at a high rate of solidification to the solidus temperature, at which point the alloy has been completely solidified. Further cooling of the solid casting below the solidus temperature continues when the solid passes the water-cooled quench block.

Figure 2:
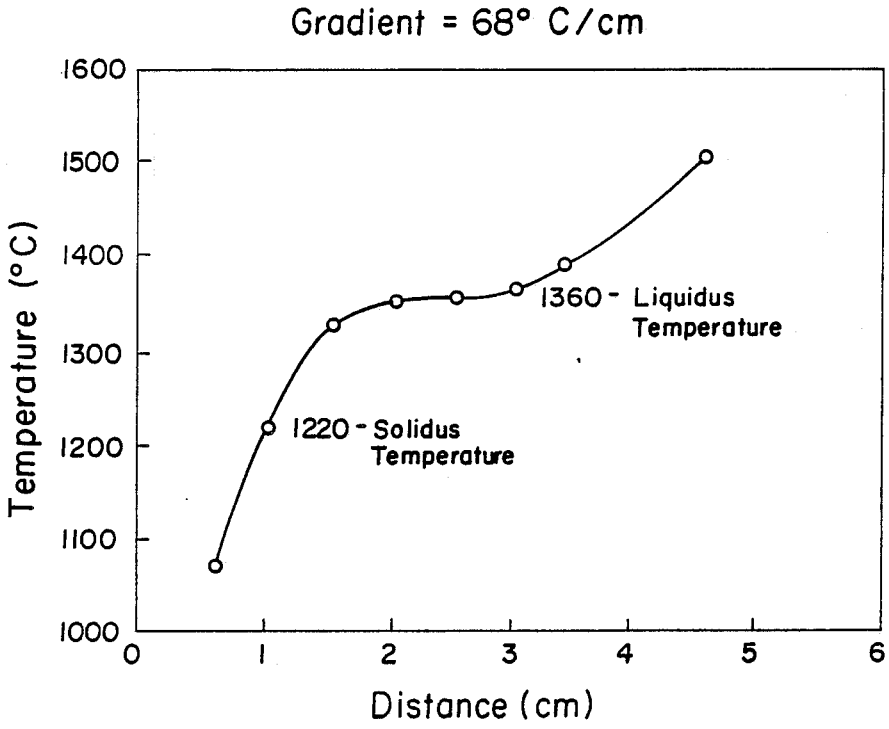
FIG. 2 represents a typical temperature profile across the solidification front for a specific superalloy for the present invention.

Referring to FIG. 2, the temperature profile of alloy Mar-M246 (Hf) is plotted with respect to distance from the beginning of the profile to the end. One rate of advance used with this temperature profile was 30 cm/hour which yielded the best results. At or near the liquidus temperature of 1360 C., the temperature is maintained almost constant, yet decreasing slightly for a period of time, depending on the desired results. This can be achieved by not inputting or only allowing enough energy input for a slight decrease in temperature to create a plateau in the temperature profile. The temperature of this plateau is at or near the liquidus temperature and as such is a function only of the composition of the alloy. The holding time at or near the liquidus temperature is chosen such as to yield high fatigue resistance in the finished casting.

After the melt has been held at the liquidus temperature for the desired amount of time, the slope of the temperature profile quickly changes and becomes much steeper until the solidus temperature is reached. In this particular instance, this occurred in heating core 5c, the thickness of this zone being about 0.7 cm. Thereafter, the solid alloy is further cooled by the quench block at a rate which is not critical.

It has been discovered that by direction solidification of an alloy, such as a superalloy, in a mold or crucible, using the specific temperature profile as described, and the specific rate of advance of 30 cm/hr of the solidification front along the axis of the casting as described, a casting is produced which exhibits a microstructure of small closely-spaced dendrite arms and which is free of eutectic phase and the carbide morphology was controlled to yield a small faceted morphology. These castings have been found to have superior fatigue resistance.

EXAMPLE I

Commercially available alloy Mar-M246 (Hf) was used. The composition of the MAR-M246 (Hf) superalloy is as follows:

| Element | Wt % |
|---|---|
| Carbon | .17 |
| Manganese | .20 |
| Silicon | .20 |
| Sulfur | .015 |
| Chromium | 10.0 |
| Cobalt | 11.0 |
| Molybdenum | 2.75 |
| Tungsten | 11.0 |
| Titanium | 1.75 |
| Tantalum | 1.75 |
| Aluminum | 5.75 |
| Hafnium | 2.0 |
| Boron | .02 |
| Zirconium | .08 |
| Iron | 1.0 |
| Copper | .10 |
| Nickel | 52.215 |

A sufficient quantity of the alloy was introduced into a 13"×5/16" o.d. crucible in a furnace as shown in FIG. 1 and as described above. The metal was melted and heated to 1550 C. by heating core 5a and was then allowed to cool to the solidus temperature of 1360 C. As the furnace cage moved upward at a rate of 30 cm/hour, the melt passed into second zone 5b where the alloy melt was maintained at a relatively constant temperature at or near 1360 degrees C., as shown in FIG. 2 as a plateau, wherein crystal nuclei begin to form. The liquid was then allowed to cool at a faster rate because the slope of the temperature profile has changed and become much steeper until reaching the solidus temperature of 1220 degrees C.

The solidified superalloy casting was then removed, heat treated, and subjected to high cycle fatigue (HCF) testing. A Weibull statistical analysis of the fatigue test results on many such castings was made and the morphology of the castings was examined. The HCF test showed an increase in characteristic life by approximately a factor of ten when compared to other microstructures created in the laboratory using the same furnace.

Directionally solidified superalloy castings produced by the methods of this invention at higher average temperature gradients and lower solidification rates exhibited markedly inferior fatigue resistance in comparison with the casting produced at average 68° C./cm using the specified temperature gradient shown in FIG. 2. The average temperature gradients were estimated using the following simple equation:

$$G = \frac{T_{Liquidus} - T_{Solidus} \text{ (in °C.)}}{\text{cm between } T_{Liquidus} \text{ and } T_{solidus}}$$

Conventionally cooled castings normally are cast using temperature profiles consisting of only one slope between the solidus and liquidus temperatures. The temperature profile shown in FIG. 2 differs in that there is more than one slope in the profile between the liquidus and solidus temperatures. Also, one part of the profile has a slope that is extremely small. This portion/slope is the plateau area to or near the liquids temperature. Thereinafter the slope of the temperature profile between the liquidus and solidus of the alloy changes and becomes much steeper, that is, the cooling rate increases. Finally, after reaching the solidus temperatures, solidification is complete. The superior fatigue resistance of the superalloy casting made in accordance with the process of this invention is attributed to the microstructure of the superalloy which is characterized by fine, blocky discrete carbides, with small dendrite arm spacing (reduced microsegregation) and virtually no eutectic phase. Further modifications of the invention will occur to persons skilled in the art, and all such modifications are deemed to be within the spirit and scope of the invention as defined in the appended claims.

What is claimed is:

1. A process for the controlled directional solidification of a superalloy melt utilizing a temperature cooling profile having a plurality of slopes comprising the following steps:

(a) cooling the melt from a temperature above its liquidus temperature to its liquidus temperature;

(b) maintaining the melt at or near its liquidus temperature for a predetermined period of time sufficient to eliminate or suppress eutectic formations; and (c) cooling then changing and increasing the slope of the temperature profile to quickly increase the cooling rate until the solidus temperature of the alloy is reached.

2. The process in accordance with claim 1 in which the alloy is MAR-M246 (Hf).

3. The process in accordance with claim 2 in which the melt is maintained at or near its liquidus temperature of 1360 C.

4. The process in accordance with claim 2 in which the melt is cooled from at or near its liquidus temperature of 1360 C. where the slope of the temperature profile between the solidus and liquidus temperatures changes from a slight slope to a steeper slope until solidification is complete as displayed in FIG. 2.

5. The process in accordance with claim 1 wherein the superalloy is a nickel based alloy.

6. The process in accordance with claim wherein the melt is maintained in step (b) for a period of time until crystal nuclei begin to form.

7. A nickel based superalloy produced in accordance with the process of claim 1.

* * * * *